US008434519B2

(12) United States Patent
Larzoe et al.

(10) Patent No.: US 8,434,519 B2
(45) Date of Patent: May 7, 2013

(54) PRESSURE REGULATOR DEVICE, ESPECIALLY OF THE HYDRAULIC REMOTE-CONTROL TYPE

(75) Inventors: Gérard Larzoe, Mions (FR); Laurent Drutel, Mions (FR)

(73) Assignee: Bosch Rexroth D.S.I. (FR)

( * ) Notice: Subject to any disclaimer, the term of this patent is extended or adjusted under 35 U.S.C. 154(b) by 179 days.

(21) Appl. No.: 13/129,039

(22) PCT Filed: Oct. 16, 2009

(86) PCT No.: PCT/FR2009/051980

§ 371 (c)(1),
(2), (4) Date: May 13, 2011

(87) PCT Pub. No.: WO2010/055240

PCT Pub. Date: May 20, 2010

(65) Prior Publication Data

US 2011/0214751 A1 Sep. 8, 2011

(30) Foreign Application Priority Data

Nov. 12, 2008 (FR) ..... 08 06293

(51) Int. Cl.
*F15B 13/06* (2006.01)

(52) U.S. Cl.
USPC ..... 137/636.1; 137/596; 137/596.2; 137/636; 251/295; 251/50; 251/53; 251/54

(58) Field of Classification Search ..... 137/596, 137/596.2, 636, 636.1; 251/295, 50, 54, 251/53
See application file for complete search history.

(56) References Cited

U.S. PATENT DOCUMENTS 3,158,178 A * 11/1964 Fiala et al. ..... 137/596.2
3,662,782 A * 5/1972 Schott ..... 137/596
3,935,792 A 2/1976 Dezelan et al.
4,753,158 A * 6/1988 Hirata et al. ..... 91/461

(Continued)

FOREIGN PATENT DOCUMENTS

FR 2376978 A 8/1978
FR 2507732 A 12/1982

(Continued)

OTHER PUBLICATIONS

International Search Report issued Nov. 1, 2010 by European Patent Office re: International Application No. PCT/FR2009/051980—citing FR2857706A, FR2835574A, FR2854668A, FR2793532A, FR2507732A, FR2376978A and US3935792A.

*Primary Examiner* — Stephen M Hepperle
*Assistant Examiner* — Minh Le
(74) *Attorney, Agent, or Firm* — Cantor Colburn LLP

(57) ABSTRACT

Pressure regulator device comprising a body (1), a minimum of a pressure reducer and a damper mounted in control and damping cavities, respectively, in the body (1), and a control member (4) pivoting on an upper face (10) of the body (1). The device is noteworthy in that the control and damping cavities have open ends in a peripheral face (12) of the body (1) and the control member (4) has parts (47) that are opposite the peripheral face (12) in order to face the open ends of the respective control and damping cavities, from which control (21) and damping pushrods, respectively, project. The present invention has an application in the hydraulic remote controls of civil engineering machines.

12 Claims, 8 Drawing Sheets

U.S. PATENT DOCUMENTS

| | | | | | |
|---|---|---|---|---|---|
| 4,827,982 | A | * | 5/1989 | Inagaki | 137/636.1 |
| 5,044,608 | A | * | 9/1991 | Hidaka et al. | 254/266 |
| 5,102,102 | A | * | 4/1992 | Hidaka et al. | 254/266 |
| 5,156,065 | A | * | 10/1992 | Fujimoto et al. | 74/527 |
| 5,251,660 | A | * | 10/1993 | Hori et al. | 137/636.1 |
| 5,305,782 | A | * | 4/1994 | Kipling et al. | 137/596 |
| 5,566,716 | A | * | 10/1996 | Togashi et al. | 137/636.1 |
| 5,743,297 | A | * | 4/1998 | Mueller | 137/636.2 |
| 5,845,680 | A | * | 12/1998 | Mototani et al. | 137/636.1 |
| 5,983,942 | A | * | 11/1999 | Mototani et al. | 137/636.1 |
| 6,125,886 | A | * | 10/2000 | Sagawa et al. | 137/625.69 |
| 6,634,383 | B2 | * | 10/2003 | Aarestad | 137/636.1 |
| 7,032,471 | B2 | * | 4/2006 | Weber et al. | 74/469 |
| 7,438,089 | B2 | * | 10/2008 | Allegretti | 137/636.1 |
| 7,467,644 | B2 | * | 12/2008 | Blanco | 137/636.1 |
| 7,562,676 | B2 | * | 7/2009 | Boudou et al. | 137/636.1 |
| 7,712,485 | B2 | * | 5/2010 | Kitten et al. | 137/636 |
| 2006/0118187 | A1 | * | 6/2006 | Boudou et al. | 137/636.1 |
| 2007/0089793 | A1 | * | 4/2007 | Allegretti | 137/636.1 |
| 2007/0137402 | A1 | * | 6/2007 | Mototani et al. | 74/519 |

FOREIGN PATENT DOCUMENTS

| | | | |
|---|---|---|---|
| FR | 2793532 | A | 11/2000 |
| FR | 2835574 | A | 8/2003 |
| FR | 2854668 | A | 11/2004 |
| FR | 2857706 | A | 1/2005 |

* cited by examiner

PRESSURE REGULATOR DEVICE, ESPECIALLY OF THE HYDRAULIC REMOTE-CONTROL TYPE

TECHNICAL HELD

The present invention relates to a pressure regulator device, especially of the hydraulic remote-control type such as a hydraulic remote control for civil engineering machines.

BACKGROUND

These regulator devices are in particular used to control various hydraulic functions such as setting various receivers in motion that are installed onboard these civil engineering machines.

The invention more particularly relates to a regulator device comprising:

a body provided with two end faces, lower and upper, respectively, and a peripheral face extending between the two end faces, and comprising at least one so-called control cavity emerging on at least one of said faces, a minimum of a pressure reducer mounted in the body and comprising a control push-piece housed in back and forth motion in the at least one control cavity, said pressure reducer being intended to enable the control of at least one receiver outside the regulator device, a control member pivoting relative to the body, at least one hinge mounted on the upper face of said body, in order to control the back and forth movement of the at least one control push-piece.

Such regulator devices are well known by those skilled in the art and are for example described in documents FR 2 507 732, FR 2 376 978, FR 2 793 532, FR 2 854 668, FR 2 857 706 and FR 2 835 574.

In these documents, the control member assumes the form of a lever or a handle, which can be actuated manually, extended by a lower shell arranged opposite the upper face of the body of the regulator device; upper face in which the control cavities emerge wherein the control push-pieces are mounted able to move, so that said control push-pieces protrude outside the upper face to abut against the lower shell of the control member. In such designs, the control cavities extend normally opposite the upper face of the body so that, once said body is fastened on a horizontal floor, the control cavities and the control push-pieces extend vertically and the body must have a height adapted to the integration of the pressure reducer. The height of the body leads to a limitation of the height space and a sometimes prohibitive vertical bulk when it involves installing the regulator device in a confined space such as, for example, a cockpit of a civil engineering machine.

Traditionally, the control cavities are made by machining and are generally made in the form of a hole passing all the way through the body in the height direction, between the lower and upper faces. Such an embodiment requires that the control cavities be connected via the lower faces, and therefore that connecting hoses be brought through the horizontal floor on which the regulator device is placed flat, thereby hindering the integration of the hoses and of the entire device on the floor. Alternatively, it is possible to consider providing bores transverse to the control cavities, making the production of the body and its various cavities or pipes more complex.

It is also known to use such regulator devices in foot-operated hydraulic remote controls. In such an application, the control member assumes the form of a tilting pedal, which can be actuated by foot, and arranged opposite the upper face of the body of the regulator device. Such a pedal can be used in civil engineering machines for forward and backward travel controls of the machine, in other words for forward or backward movement or the translation of the machine. As in the aforementioned documents, these regulator devices comprise control cavities and control push-pieces extending vertically with the same drawbacks as mentioned above.

In a known manner, an additional control lever is hinged on one of the ends of the pedal and extends upward to end with a handle that can be manipulated manually in order to add a control for the tilting of the pedal. Such a control lever is used to impose tilting of the pedal from front to back, or vice versa, that is more precise than that obtained directly with the food placed on the pedal, in particular to allow more precise movement of the civil engineering machine.

However, such a control lever represents a mass situated at one of the ends of the pedal, therefore off-center relative to the hinge of the pedal, the inertia of which must be combated using a damper. It is thus known to arrange at least one damper mounted in the body and comprising two damping push-pieces arranged on either side of the hinge of the control member (here the pedal) and housed in back and forth motion in a damping cavity provided in the body, said damper being intended to damp the tilting of the control member in both directions, said control member pushing one of said damping push-pieces when it tilts in one direction, on one hand, and the other of said damping push-pieces when it tilts in the other direction, on the other hand. Thus, this damper is adapted to damp the tilting of the pedal, and in particular the tilts imposed by a control lever during movement of the civil engineering machine.

In a known manner, the damping cavity is generally U-shaped with two vertical portions extending normally opposite the upper face of the body and in which the respective damping push-pieces move, and a central portion forming the connection between the vertical portions and provided with one or several damping pistons. Thus, the damping push-pieces extend normally opposite the upper face of the body so that, once the body is fastened on a horizontal floor, the damping push-pieces extend vertically with the same drawbacks as those mentioned for the control push-pieces. Moreover, such a damping cavity is difficult to produce, at least by simple machining, due to its complex U shape.

Generally, the known regulator devices are too high, requiring hydraulic connections at the lower face of the body, and are complex to produce.

BRIEF SUMMARY

The aim of the invention is in particular all or some of the aforementioned drawbacks, and to that end it proposes a pressure regulator device, in particular of the hydraulic remote-control type, comprising:

a body provided with two end faces, lower and upper, respectively, and a peripheral face extending between the two end faces, and comprising at least one so-called control cavity emerging on at least one of said faces and at least one so-called damping cavity emerging on at least one of said faces, a minimum of a pressure reducer mounted in the body and comprising a control push-piece housed in back and forth motion in the at least one control cavity, said pressure reducer being intended to enable the control of at least one receiver outside the regulator device, a control member pivoting relative to the body, at least one hinge mounted on the upper face of said body, in order to control the back and forth movement of the at least one control push-piece, and at least one damper mounted in the body and comprising two damping push-pieces arranged on either side of said hinge and housed in back and forth motion in said at least one damping cavity, said damper being intended to damp the tilting of the control member in both directions, said control member pushing on one hand one of said damping push-pieces when it tilts in one direction, and on the other hand the other of said damping push-pieces when it tilts in the other direction, the device being remarkable in that:

the at least one control cavity has one end emerging in the peripheral face of said body, the at least one damping cavity has two ends emerging in the peripheral face of said body on either side of said hinge of the control member, and the control member has portions opposite the peripheral face to face the emerging ends of the control and damping cavities, respectively, from which the control and damping push-pieces emerge, respectively.

Thus, the control and damping cavities do not extend normally to the upper face of the body, and therefore vertically once the device is placed flat on a horizontal floor, thereby contributing to limiting the vertical bulk of the device and saving height space. For example, the control and/or damping cavities can extend parallel to the upper face of the body, and therefore horizontally once the device is placed flat on a horizontal floor.

Moreover, with such a configuration, the control and damping cavities cannot emerge in the lower face so that it is not necessary to connect the connecting hoses on said lower faces, thereby facilitating the installation of said hoses at the floor of the machine.

According to one feature, the regulator device comprises a single rectilinear damping cavity passing all the way through the body and emerging at both of its ends on its peripheral face.

Thus, it is easy to make such a damping cavity by simple machining, in a single and same direction.

According to another feature, the at least one control cavity is rectilinear and extends substantially parallel or inclined relative to the damping cavity.

Likewise, this control cavity is easy to make by machining.

According to still another feature, the damping cavity and the at least one control cavity extend in substantially parallel planes.

In one particular embodiment, the damper comprises a damping slide slidingly and adjustably mounted in the damping cavity, and in which the damping cavity comprises two work chambers, with a variable volume in the opposite direction, extending between the two opposite ends of said damping slide and guide sleeves immobilized at the emerging ends of the damping cavity to guide the respective damping push-pieces in translation, said work chambers containing a fluid intended to pass from one to the other by means of at least one communication passage under the effect of the thrust from one or the other of the damping push-pieces on said damping slide.

Thus, the damping slide is mounted simply between the two damping push-pieces, making it possible to have a linear damper comprising these three pieces successively aligned one after the other.

Advantageously, the communication passage comprises at least one restriction zone adapted to create a load loss in said communication passage when it is passed through by fluid flowing between the two work chambers.

This communication passage is made either in the damping slide, or in the body.

Advantageously, the damping slide comprises, at its two respective ends, two respective end pistons sliding in the damping cavity, connected to each other by a central rod, and against which the respective damping push-pieces abut, and wherein the communication passage between the two work chambers is formed in the damping slide between said two end pistons.

Thus, the damping push-pieces, mounted back to back or antagonistically, abut against the two ends of the damping slide.

In one particular embodiment, the communication passage comprises two end channels formed in said end pistons and a central channel formed axially in the central connecting rod between the two end pistons, said end channels putting the respective work chambers and the central channel in fluid communication.

According to one feature, the central channel passes all the way through the two end pistons, wherein the damping push-pieces are dimensioned to cover the respective emerging ends of the central channel, and wherein the end channels assume the form of grooves formed on the end faces of the respective end pistons and putting the respective work chambers and the respective emerging ends of the central channel in fluid communication.

Advantageously, the grooves have a general spiral shape adapted to form a throttle in the flow of the fluid between the respective work chambers and the central channel.

According to another feature, the central channel is inwardly provided with two antagonistic jets designed to create load losses in the flow of the fluid inside said central channel.

According to another feature, the distribution slide comprises two intermediate pistons sliding in the damping cavity and arranged around the central rod between the end pistons, so that the distribution slide inwardly defines three inner chambers with a constant volume, i.e. two lateral inner chambers arranged between the end pistons and the adjacent intermediate pistons, and a central inner chamber arranged between the two intermediate pistons.

In one particular embodiment of the invention, the at least one pressure reducer comprises:

a compensation chamber provided in the control cavity and in which the control push-piece is mobile, a return pipe emerging in the compensation chamber and connected to a low pressure fluid source, a distribution channel provided in the control cavity in extension of the compensation chamber with which it is in communication at one of its ends, an intake pipe emerging in the distribution channel and connected to a high pressure fluid source, an outlet pipe connected to the distribution channel and intended to be connected to the outer receiver to control, a plunger able to be moved in translation by the control member, via the control push-piece, inside the compensation chamber, and a distribution slide secured in motion with the plunger between a start position and an end-of-travel position, said distribution slide comprising a blind axial channel emerging at the free end of the slide in the distribution channel in order to communicate with the outlet pipe, said axial channel also communicating with a lateral channel capable of being put selectively in communication with the compensation chamber or the intake pipe to perform the pressure reducing function during movement of the distribution slide in the distribution channel.

According to other advantageous features of the invention, considered alone or in combination:

the intake pipe of the at least one pressure reducer emerges in the central inner chamber of the damping slide;

the device also comprises a connecting pipe for the at least one reducer, said connecting pipe emerging on one hand in the compensation chamber of said reactor and on the other hand in one of the lateral inner chambers of the damping slide;

the device comprises two pressure reducers arranged in two respective control cavities, wherein the intake pipes of the two pressure reducers emerge in the central inner chamber of the damping slide, and wherein the connecting pipe of one of the pressure reducers emerges in one of the lateral inner chambers of the damping slide while the connecting pipe of the other of the pressure reducers emerges in the other of the lateral inner chambers of the damping slide;

the central rod of the distribution slide includes two channels putting the lateral inner chambers and the central channel in communication, such that the respective compensation chambers of the two pressure reducers are in communication via the connecting pipes, the lateral inner chambers, said communication channels and the central channel.

BRIEF DESCRIPTION OF THE DRAWINGS

Other features and advantages of the present invention will appear upon reading the following detailed description of two non-limiting examples of embodiments, done in reference to the appended figures, in which.

DETAILED DESCRIPTION

Figure 1:
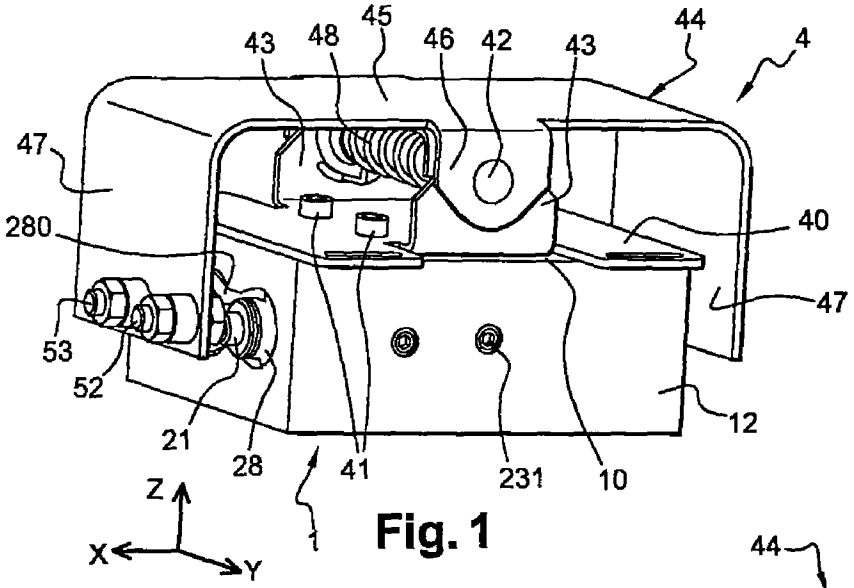
FIGS. 1 to 8 illustrate a regulator device according to the invention, where the figures are perspective, top, front, side, bottom, vertical cross-sectional along axis VI-VI of FIGS. 3 and 5, vertical cross-sectional along axis VII-VII of FIGS. 3 and 5, and horizontal cross-sectional along axis VIII-VIII of FIGS. 3 and 4 views of the device, respectively.
Figure 2:
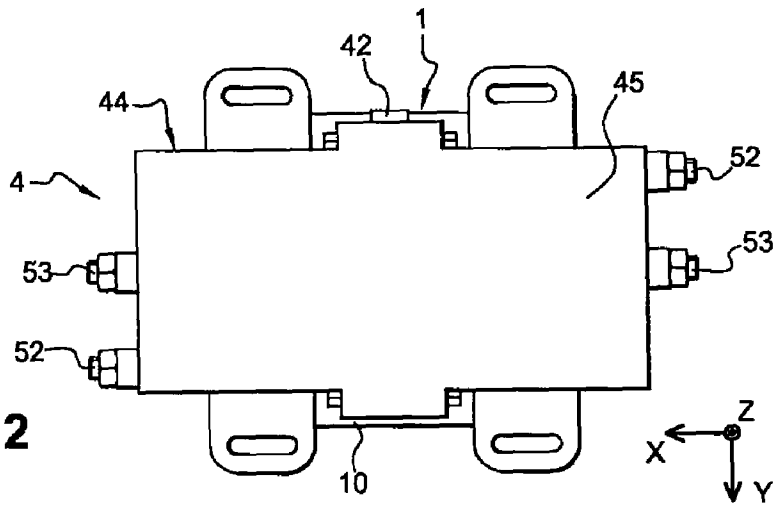
Figure 4:
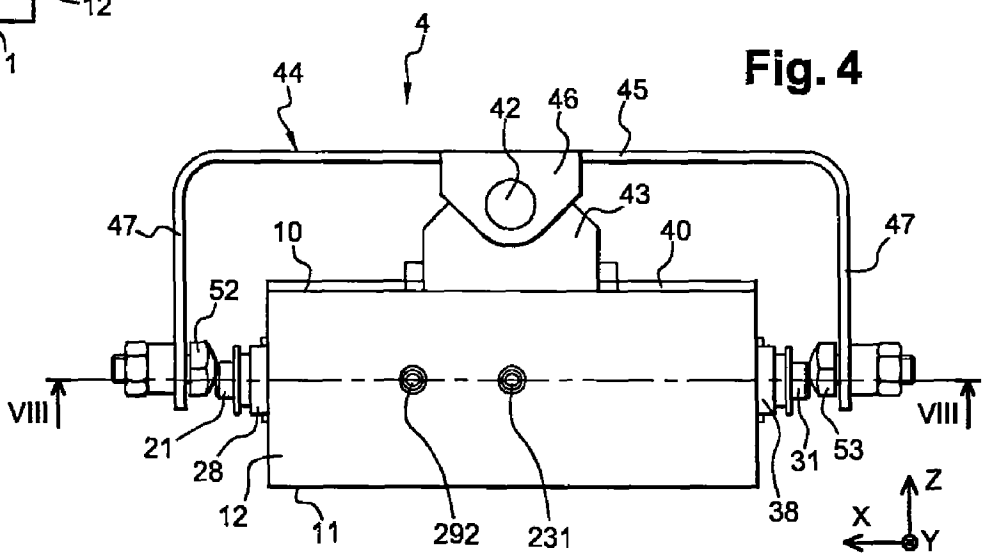
Figure 3:
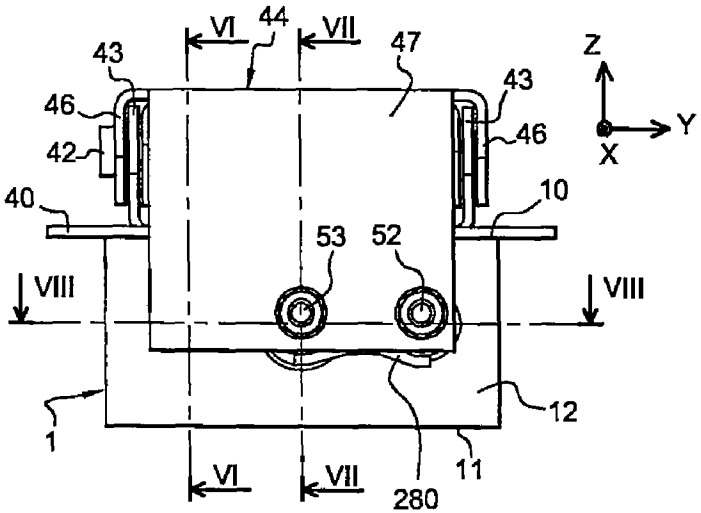
Figure 5:
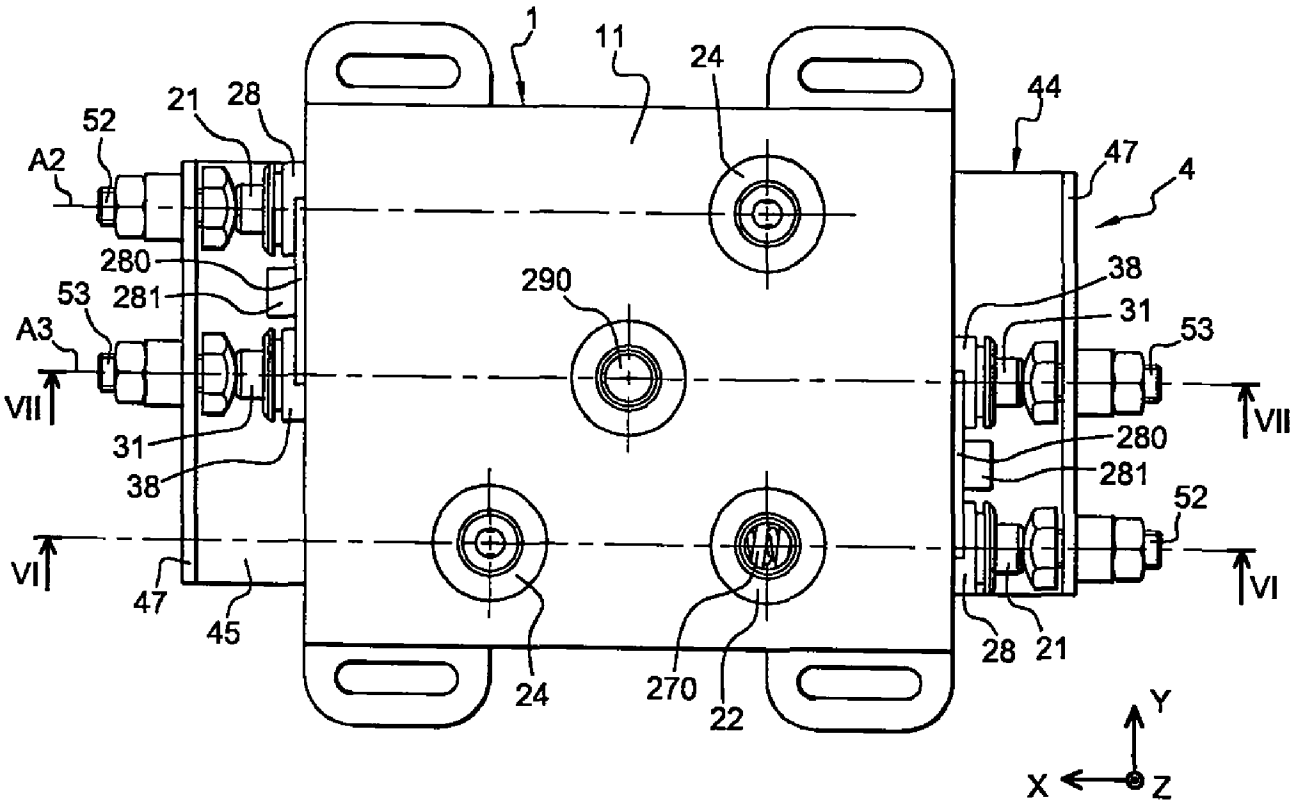
Figure 6:
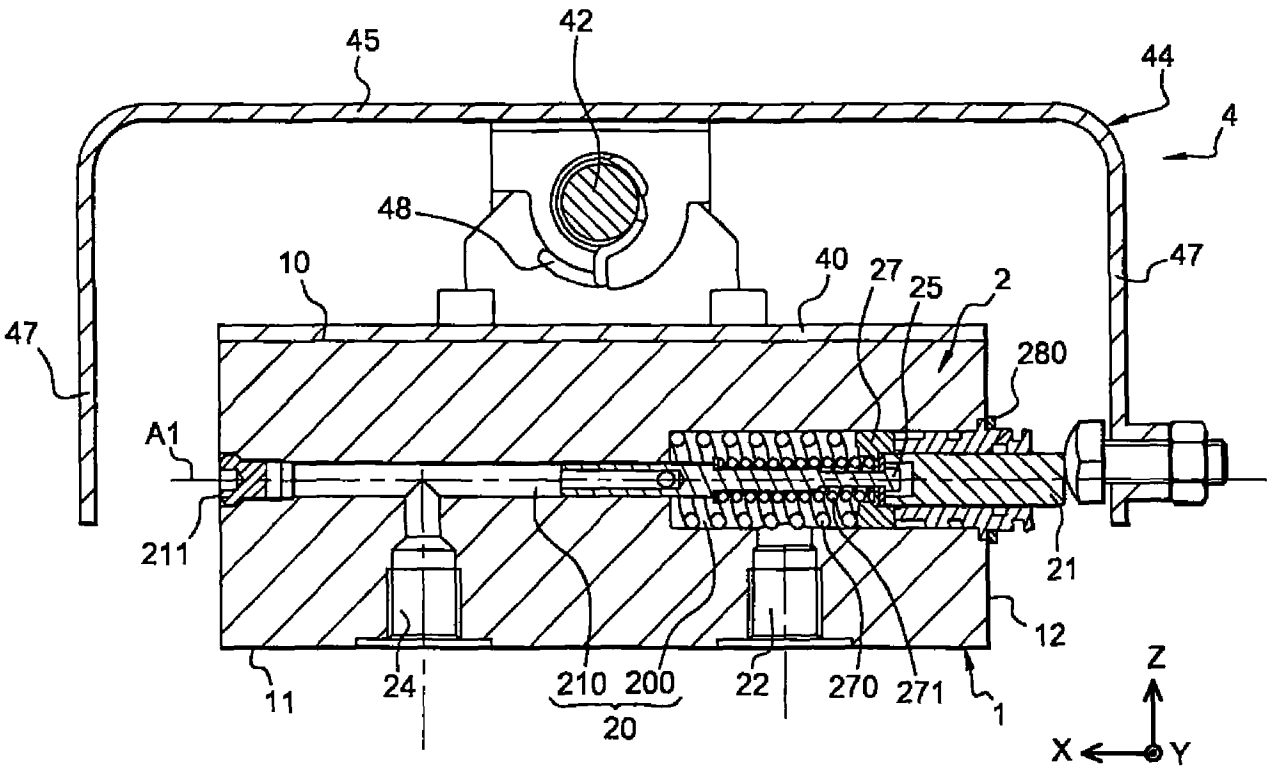

A regulator device according to the invention is described below in reference to FIGS. 1 to 8, which more particularly illustrate a regulator device designed for a foot-operated hydraulic remote control, of the hydraulic pedal type, intended for example to control the translation of a civil engineering machine.

In reference (X, Y, Z), illustrated in the figures, the various axes are as follows, in reference to the machine intended to be equipped with the regulator device:

the X axis indicates the longitudinal direction of the machine corresponding to the normal direction of travel of the machine in a straight line, in other words the direction of translational movement, oriented from back to front;

the Y axis indicates the transverse direction of the machine, oriented from right to left, where the two axes X and Y are perpendicular and horizontal; and the Z axis indicates the vertical direction of the machine, oriented from bottom to top.

The regulator device is provided to be placed flat on a horizontal floor, i.e. a floor parallel to plane (X, Y), and fastened thereon. The regulator device comprises a body 1 in which two pressure reducers 2 and a damper 3 are housed, and on which a control member 4 is installed. This control member 4 is capable of modifying the pressure regulated by the pressure reducers 2 described below.

The body 1 is provided with two end faces, i.e. a lower face 11 and an upper face 10, as well as a peripheral face 12, or lateral face, extending between the two end faces 10, 11. The end faces 10, 11 extend in a horizontal plane, while the peripheral face 12 extends vertically and forms the perimeter of the body 1. The body 1 here has a generally parallelepiped shape with rectangular end faces 10, 11 and a peripheral face 12 having facets that are also rectangular.

The control member 4 assumes the form of a pedal able to be actuated by foot and comprises:

a planar base 40 fixedly attached on the horizontal upper face 10 of the body 1, in particular using fastening screws 41, and supporting a hinge pin 42 parallel to the transverse direction Y;

a pedal 44, rotatably mounted relative to the base 40 around the hinge pin 42;

a return means 48, of the helical spring type, mounted around the hinge pin 42 to return said pedal 44 to the idle position illustrated in the various figures.

To support the hinge pin 42, the base 40 has two rebates 43 protruding normally at the base 40, where said rebates 43 are parallel to the vertical plane (X, Z) and spaced apart from each other in the transverse direction Y in order to support the transverse hinge pin 42.

The pedal has a general arch or inverted "U" shape and includes:

a planar central portion 45 having two rebates 46 parallel to the rebates 43 of the base 40 in order to also support the hinge pin 42, where the central portion 45 extends horizontally in the idle position and where said central portion 45 offers a support surface for a foot; and two parts laterally folded down 47 opposite each other in the longitudinal direction X, said laterally folded-down portions 47 extending at a right angle relative to the central portion 45, in a plane parallel to the plane (Y, Z) in the idle position, and coming opposite the peripheral face 12 of the body 1.

The laterally folded-down portions 47 extend parallel to the hinge pin 42 so that, during tilting of the pedal 44, said laterally folded-down portions 47 more or less approach or move away from the peripheral face 12, antagonistically, in the direction of the tilting.

Several cavities are formed in the body 1, i.e.:

a single damping cavity 30 extending rectilinearly and horizontally in longitudinal direction X, perpendicular to the axis of rotation 42 of the pedal 44, and emerging at both of its opposite ends 31 in the peripheral face 12 of the body 1; and two control cavities 20 also extending rectilinearly and horizontally in the longitudinal direction X, and emerging at both of their respective opposite ends 21 in the peripheral face 12 of the body 1.

The damping cavity 30 assumes the form of a bore with a constant diameter over part of its length and centered around an axis A3 parallel to the longitudinal direction X; said damping cavity 30 being obtained by a traditional machining technique that is easy to implement.

The control cavities 20 assume the form of two successive bores with different diameters and centered around an axis A1 or A2 parallel to the longitudinal direction X.

Each pressure reducer 2 comprises:

a control push-piece 21 housed in back and forth movement in the corresponding control cavity 20;

a compensation chamber 200 provided in the control cavity 20 and in which the control push-piece 21 is able to move, said compensation chamber 200 corresponding to a bore with a given diameter that is centered around an axis A1 or A2 parallel to the longitudinal direction X and that emerges in the peripheral face 12 of the body 1;

a return pipe 22 emerging in the compensation chamber 200 and connected to a low-pressure fluid source, said return pipe 22 emerging in the lower face 11 of the body 1 and extending parallel to the vertical axis Z;

a distribution channel 210 directly extending the compensation chamber 200 with which it is in communication at one of its ends, the distribution channel 210 corresponding to a bore with a diameter smaller than that of the compensation chamber 200, which is centered around the same axis A1 or A2 as the adjacent compensation chamber 200, and which emerges in the peripheral face 12 of the body 1, opposite the compensation chamber 200, with a stopper 211 screwed at the emerging end of said distribution channel 210;

an intake pipe 23 emerging in the distribution channel 210 and connected to a high-pressure fluid source, said intake pipe 23 being formed by a bore passing through the distribution channel 210, parallel to the transverse direction Y and emerging in the peripheral face 12 of the body 1, with a stopper 231 screwed at the emerging end of said intake pipe 23;

an outlet pipe 24 emerging in the distribution channel 210 and intended to be connected to the outer receptor to be controlled, said outlet pipe 24 emerging in the lower face 11 of the body 1 and extending parallel to the vertical axis Z;

a plunger 25 able to be moved in translation, along axis A1 or A2, by the control member 4, via the control push-piece 21, inside the compensation chamber 200; and a distribution slide 26 secured in movement to the plunger 25 between a starting position and an end-of-travel position, said distribution slide 26 comprising a blind axial channel 260 emerging at the free end of said slide 26 in the distribution channel 210 in order to communicate with the outlet pipe 24, said axial channel 260 also communicating with a lateral channel 261 capable of being selectively put in communication with the compensation chamber 200 or the inlet pipe 23 to perform the pressure reducing function when the distribution slide 26 is moved in the distribution channel 210.

The fluid circulating in the intake pipe 23 and the fluid circulating in the compensation chamber 200 (and also in the return pipe 22) are respectively qualified as high pressure and low pressure relative to each other, independently of any absolute pressure value.

The plunger 25 essentially comprises a rod extending between a widened head facing the control member 4 and a connecting foot facing the distribution channel 210. The connecting foot of the plunger 25 is mounted secured in translation to a first end of the distribution slide 26; the second end of said slide 26 corresponding to its free end in which the axial channel 260 emerges.

Each reducer 2 also comprises a shell 27 mounted coaxial to the shaft of the plunger 25 while bearing against the lower portion of the broadened head of said plunger 25 to be elastically pushed back using a first return spring 270 against the control plunger 21. The first return spring 270 is inserted between the shell 27 and a shoulder defined in the control cavity 20, to push the shell 27 back towards the control push-piece 21.

The reducer 2 may comprise a second return spring 271, called calibrating or regulator spring, arranged inside the first return spring 270 and inserted between a shoulder of the plunger 25 and the shell 27.

The translational guiding of each control push-piece 21 is ensured by a guide sleeve 28 immobilized at the emerging end of the compensation chamber 200 in the peripheral face 12 of the body 1; said guide sleeve 28 being immobilized using a closing plate 280 fastened on the peripheral face 12 of the body 1, in particular using a screw 281. Two peripheral grooves are formed in each guide sleeve 28, respectively at the inner surface and the outer surface of said sleeve 28, to receive sealing devices in order to ensure the sealing between the control push-piece 21 and the sleeve 28 and body 1, respectively.

The operation of such pressure reducers is well known and will not be described in more detail here. For precisions, one may for example refer to the aforementioned documents FR 2 507 732, FR 2 376 978, FR 2 793 532, FR 2 854 668, FR 2 857 706 and FR 2 835 574.

According to one essential feature of the invention, the control cavities 20, and more particularly the compensation chambers 200, emerge in the peripheral face 12 of the body 1, such that the control push-pieces 21 partially protrude outside the peripheral face 12 of the body 1 in order to bear against the respective laterally folded-down portions 47 of the pedal 44. In this case, one of the control push-pieces 21 protrudes outside the body 1 to bear against one of the laterally folded-down portions 47, while the other of the control push-pieces 21 protrudes outside the body 1 to bear against the other of the laterally folded-down portions 47. The control push-pieces 21 move antagonistically, or in the opposite direction in the longitudinal direction X, under the action of the control member 4.

When the pedal 44 tilts in one direction, one of the laterally folded-down portions 47 approaches the peripheral face 12 and pushes the corresponding control push-piece 21 inside the corresponding compensation chamber 200, while the other of the laterally folded-down portions 47 moves away from the peripheral face 12 while keeping the contact with the other control push-piece 21, which is pushed towards the outside of the corresponding compensation chamber 200 by the first return spring 270. When the pedal 44 tilts in the other direction, the movements are reversed.

The laterally folded-down portions 47 each support a finger 52 designed to bear against the respective control push-piece 21; said finger 52 assuming the form of a screw whereof the head offers a slightly rounded support surface, for the corresponding control push-piece 21, and the free end of which cooperates with a nut for fastening on the corresponding laterally folded-down portion 47.

The damper 3 comprises:

two damping push-pieces 31 housed in back and forth motion in the damping cavity 30 at its respective emerging ends so that the tilting of the control member 4 in one direction pushes one of said damping push-pieces 31 and the tilting in the other direction pushes the other of said damping push-pieces 31; and a damping slide 32 slidingly and adjustably mounted in the damping cavity 30 between the two damping push-pieces 31 in order to damp the movements of the damping push-pieces 31 and therefore of the tilting of the control member 4.

The translational guiding of each damping push-piece 31 is ensured by a guide sleeve 38 immobilized at the emerging ends of the damping chamber 30 in the peripheral face 12 of the body 1; said guide sleeve 38 being immobilized using the aforementioned closing plate 280, which is fastened on the peripheral face 12 of the body 1. Two peripheral grooves are formed in each guide sleeve 38, respectively at the inner surface and the outer surface of said sleeve 38, to receive sealing devices in order to ensure the sealing between the damping push-pieces 31 and the respective sleeves 38 and the body 1, respectively.

The damping slide 32 comprises:

two end pistons 33 formed at the respective opposite ends of said slide 32, said end pistons 33 being slidingly mounted in the damping cavity 30, at its two emerging ends, on one hand, and on the other hand abutting against the respective damping push-pieces 31;

a central rod 34 connecting the two end pistons 33, centered on the longitudinal axis A3; and two intermediate pistons 35 formed on the perimeter of the central rod 34 and arranged spaced apart from each other between the two end pistons 34, said intermediate pistons 35 on one hand being slidingly mounted in the damping cavity 30 and on the other hand each provided with a peripheral groove formed on the outer surface of said intermediate pistons 35 to receive the sealing devices.

The damping cavity 30 thus comprises two work chambers 300, with variable volume in opposite directions (in other words whereof the volumes vary antagonistically), extending between the two opposite end pistons 33 and the adjacent guide sleeves 38; said work chambers 300 containing a fluid intended to go from one to the other via at least one communication passage under the effect of the thrust from one or other of the damping push-pieces 31 on one or the other of the end pistons 33 of the damping slide 32.

The damping push-pieces 31, mounted back to back or antagonistically, abut against the two end pistons 33 of the damping slide 32, and move in said work chambers 300.

Figure 7:
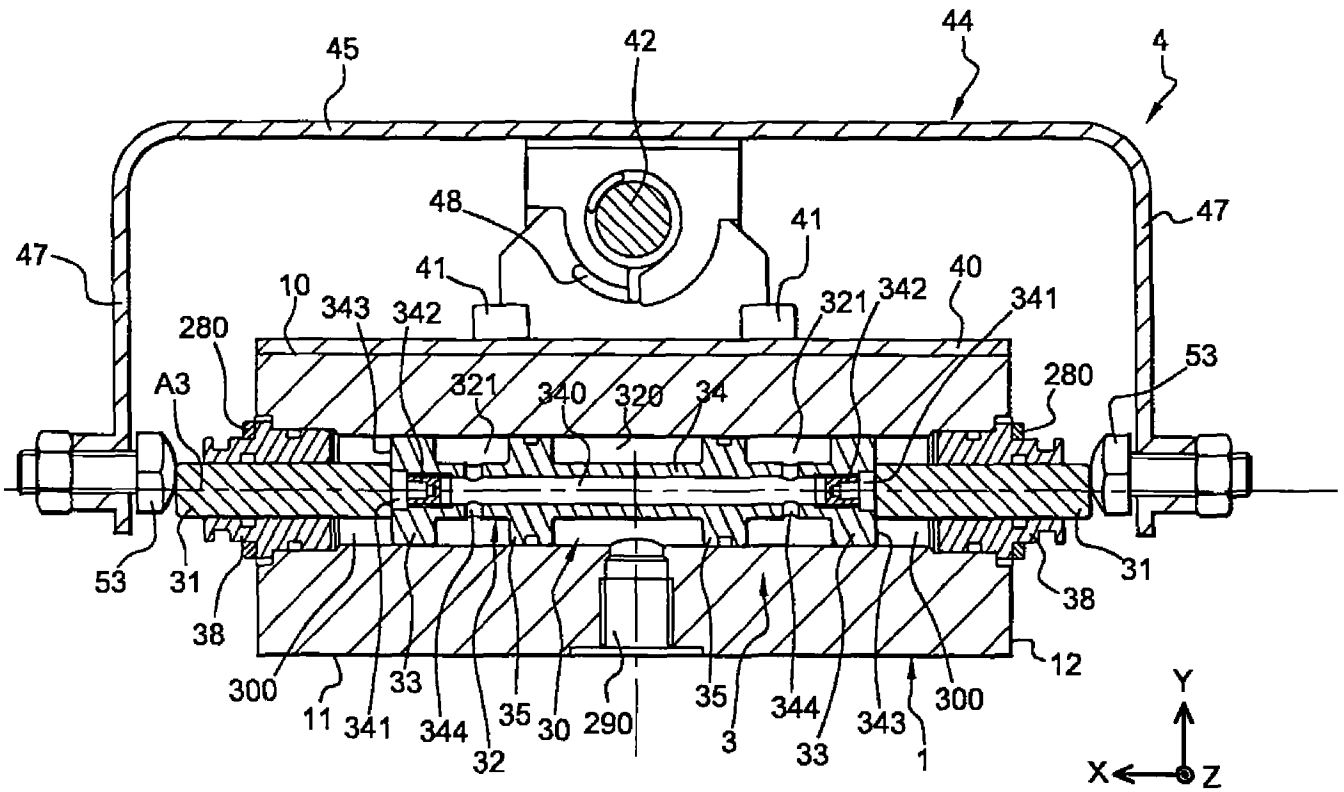
Figure 8:
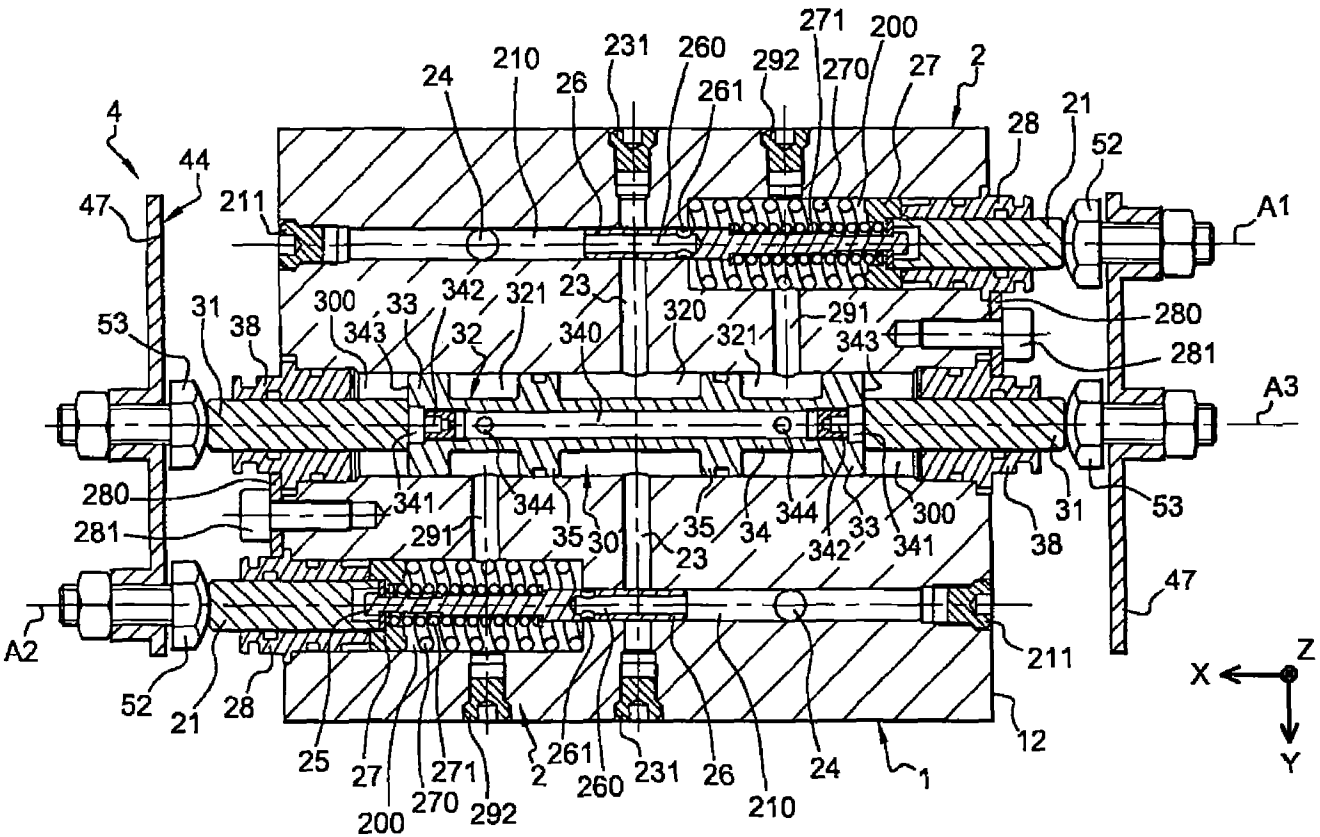

In reference to FIG. 7, when the pedal 44 tilts towards the left, in other words pivots in the counterclockwise direction, the left laterally folded-down portion 47 pushes the left damping push-piece 31 inside the damping cavity 30, the damping push-piece 31 thus pushes the damping slide 32 to the left, said damping slide 32 thus pushes the right damping push-piece 31 outside the damping cavity 30, so that said right damping push-piece 31 thus remains in contact with the right laterally folded-down portion 47, which moves away from the peripheral face 12 of the body 1. Thus, the volume of the left work chamber 300 increases while that of the right work chamber 300 decreases, such that a fluid portion contained in the right work chamber 300 goes into the left work chamber 300.

According to another essential feature of the invention, the damping cavity 30 emerges at both of its ends in the peripheral face 12 of the body 1, such that the damping push-pieces 31 protrude partially outside the peripheral face 12 of the body 1 in order to bear against the respective laterally folded-down portions 47 of the pedal 44. In that case, one of the damping push-pieces 31 protrudes outside the body 1 to bear against one of the laterally folded-down portions 47, while the other of the damping push-pieces 31 protrudes outside the body 1 to bear against the other of the laterally folded-down portions 47. The damping push-pieces 31 move antagonistically, or in the opposite direction in the longitudinal direction X, under the action of the control member 4.

The laterally folded-down portions 47 each bear a finger 53 designed to bear against the respective damping push-piece 31; said finger 53 assuming the form a screw whereof the head offers a support surface, slightly rounded, for the corresponding damping push-piece 31, and the free end of which cooperates with a nut for fastening on the corresponding laterally folded-down portion 47. Thus, each laterally folded-down portion 47 supports two fingers 52, 53 side by side and extending in a longitudinal plane.

The damping slide 32 inwardly defines three inner chambers with a constant volume, i.e.:

a central inner chamber 320 arranged between the two intermediate pistons 35, around the central rod 34; and two lateral inner chambers 321, arranged between the end pistons 33 and the adjacent intermediate pistons 35, around the central rod 34.

Moreover, the damping slide 32 comprises a longitudinal (or axial) central channel 340 formed in the central rod 34; said central channel 340 passing through the central rod 34 over the entire length thereof and also passing through the two end pistons 33 such that said central channel 340 has two ends 341 emerging in the end pistons 33. The central channel 340 is also inwardly provided with two antagonistic jets 342 designed to create load losses in the flow of the fluid inside said central channel 340; said jets 342 are formed substantially inside the end pistons 33.

The damping slide 32 comprises two radial channels 344 formed in the central rod 34 and putting the central channel 340 in communication with the respective lateral inner chambers 321; said radial channels 344 being arranged between the two jets 342 and emerging in the respective lateral inner chambers 321 and in the central channel 340.

Moreover, the damping slide 32 comprises two end channels 343 formed in said end pistons 33 in order to put the respective work chambers 300 and the central channel 340 in fluid communication. The end channels 343 are made in the form of grooves formed on one of the end faces of the respective end pistons 33, corresponding to the end faces of the damping slide partially defining the work chambers 300, and putting said respective work chambers 300 and the respective emerging ends 341 of the central channel 34 in fluid communication.

The damping push-pieces 31 are sized to cover the respective emerging ends 341 of the central channel 34 such that, when the damping push-pieces 31 are moved, the fluid circulates between the work chambers 300 and the central channel 340 via the respective grooves 343, and not directly in the emerging ends 341 that are plugged. The grooves 343 have a general spiral shape adapted to form a throttling in the flow of the fluid between the respective work chambers 300 and the central channel 340, in order to participate in the desired damping of the movement of the push-pieces 31. The spiral grooves 343 thus have a first end far enough from the axis A3 so as not to be obstructed by the corresponding damping push-piece 31, and a second end emerging in the respective emerging end 341 of the central channel 340.

Thus, the passage of fluid between the two work chambers 300 comprises the grooves 343 and the central channel 340, with four restriction zones in the flow of the fluid, i.e. the two jets 342 and the two spiral grooves 343.

Several communications are provided between the reducers 2 and the damper 3.

First, the intake pipes 23 of the reducers 2 emerge in the central inner chamber 320 of the damping slide 32. Thus, the intake pipes 23 of the two reducers 2 are made in the form of a single bore passing through the body 1 on either side along the transverse direction Y. As a reminder, the intake pipes 23 are connected to a high pressure fluid source. To that end, a main intake pipe 290 emerges on one hand in the central inner chamber 320 of the damping slide 32, and on the other hand in the lower face 11 of the body 1 to be connected to a low-pressure fluid source; said main intake pipe 290 extending parallel to the vertical axis Z.

Secondly, the device comprises two connecting pipes 291 to put the compensation chambers 200 of the two reducers 2 in communication, i.e.:

a first connecting pipe 291 emerging on one hand in the compensation chamber 200 of one of the reducers 2, and on the other hand in one of the distal inner chambers 321 of the damping slide 32;

a second connecting pipe 291 emerging on one hand in the compensation chamber 200 of the other of the reducers 2, and on the other hand in the other of the distal inner chambers 321 of the damping slide 32.

The connecting pipes 291 are made in the form of bores parallel to the transverse direction Y, passing through the respective compensation chambers 200, and emerging in the peripheral face 12 of the body 1, with a stopper 292 screwed at the respective emerging ends of said connecting pipes 291.

Moreover, as described above, the two distal inner chambers 321 of the damping slide 32 are in communication via the radial channels 344 and the central channel 340. In this way, the compensation chambers 200 of the two reducers 2 are in fluid communication via the two connecting pipes 291, the two distal inner chambers 321, the two radial channels 344 and the central channel 340. Thus, as visible in FIG. 5, only one of the reducers 2 includes a return pipe 22 emerging in the lower face 11 of the body 1 to be connected to a low pressure fluid source.

In the embodiment illustrated in FIGS. 1 to 8, the axes A1 and A2 of the reducers 2, the control cavities 20 and the control pistons 21 are horizontal and parallel to the longitudinal direction X.

Figure 9:
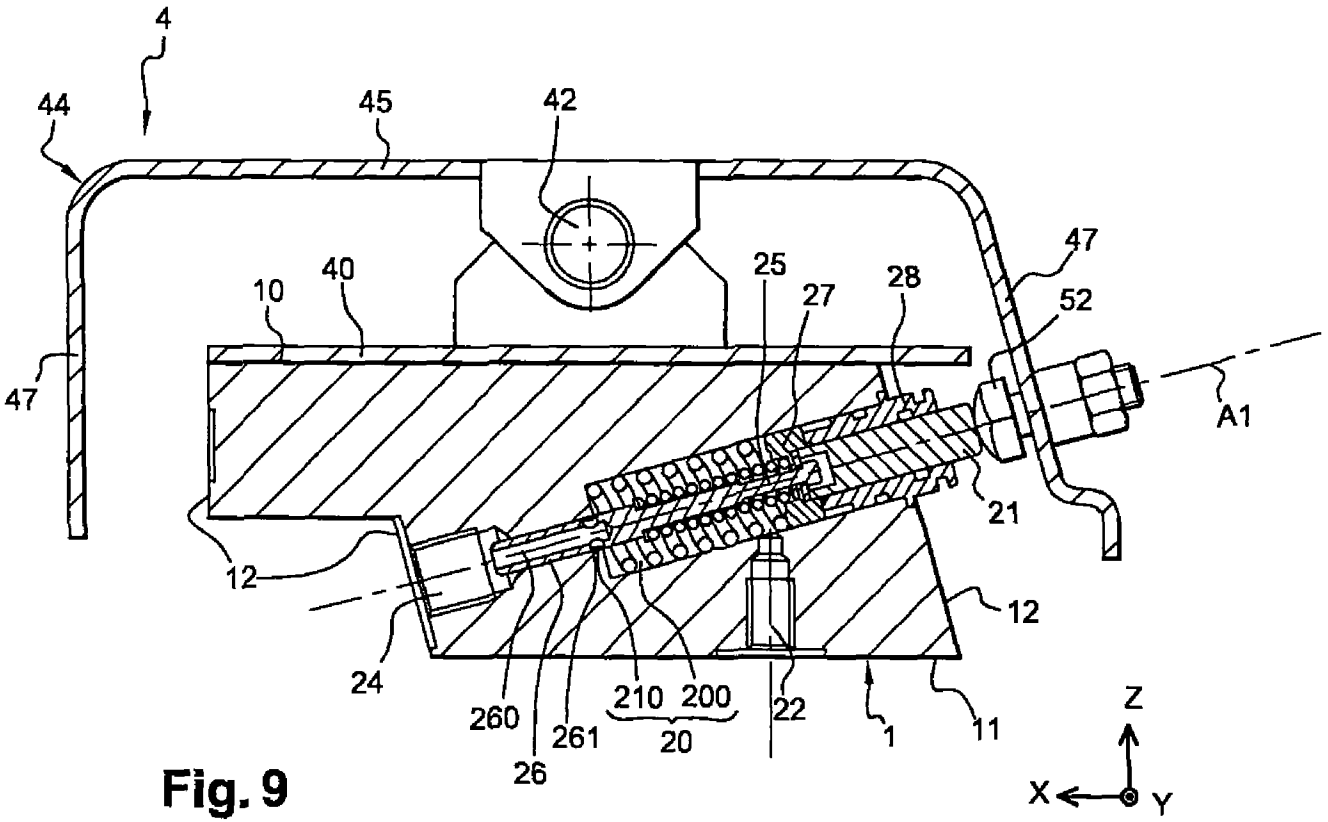
FIGS. 9 and 10 illustrate an alternative embodiment of the regulator device according to the invention, where the figures are views of the device identical to FIGS. 6 and 4, respectively.
Figure 10:
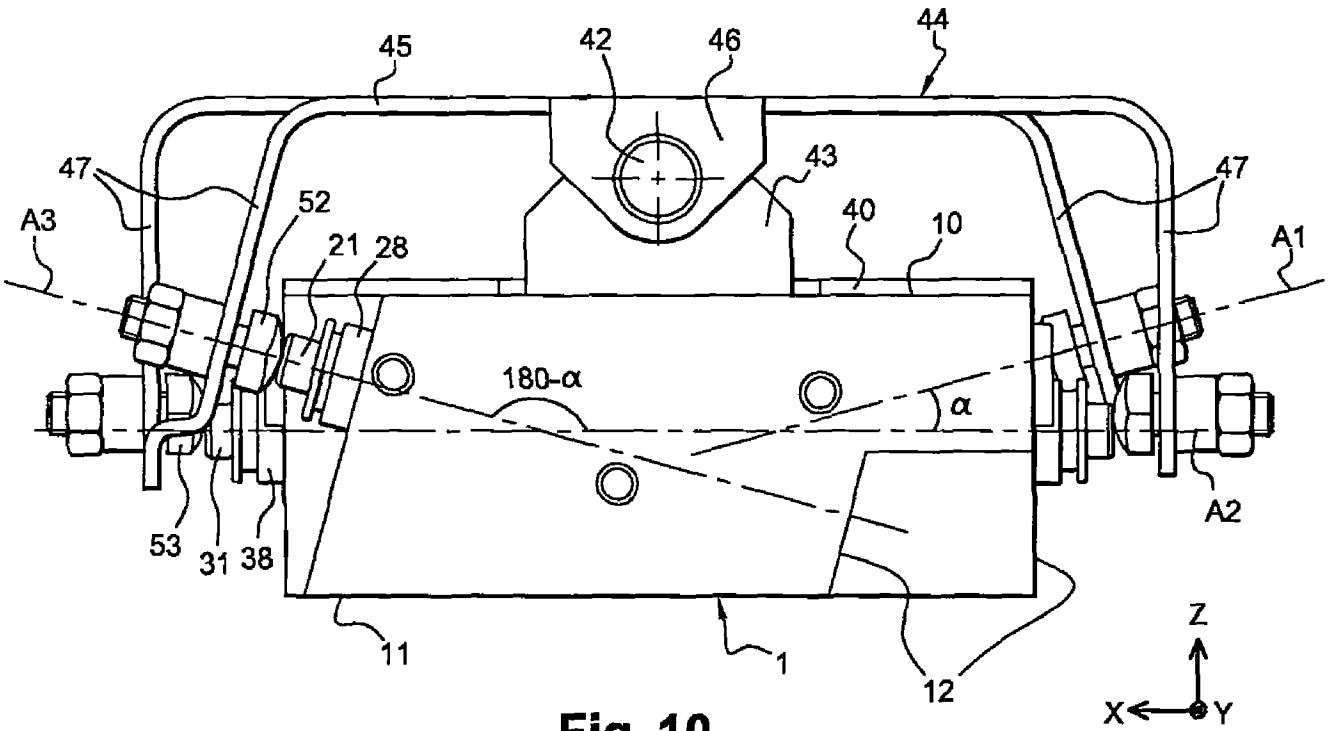

In the embodiment illustrated in FIGS. 9 and 10, the axes A1 and A2 of the reducers 2, the two control cavities 20 and the two control pistons 21 are inclined relative to the longitudinal direction X symmetrically relative to the median plane parallel to the plane (Y, Z). Thus, the axis A1 is inclined relative to the longitudinal direction X by an angle $\alpha$ given in degrees, while the axis A2 is inclined relative to the longitudinal direction X by an angle of $(180-\alpha)$ in degrees. The angle $\alpha$ is greater than or equal to 0 degrees (embodiment illustrated in FIGS. 1 to 8) and strictly less than 90 degrees, preferably between 0 and 45 degrees, or even between 0 and 25 degrees, for reasons of vertical bulk. Indeed, a slight incline of the axes A1 and A2 makes it possible to improve the control of the pedal 44 on the control push-pieces 21.

Thus, the regulator device according to the invention makes it possible to reduce the overall height of the device, in particular by reducing the height of the body 1, and to make cavities inside the body 1 simply, with or without through bores. It also makes it possible to ensure the damping in both directions of tilting of the control member 4 using a single damping slide 32, of the piston type, mounted in a rectilinear damping cavity 30.

Moreover, the outlet pipe 24 described in reference to FIGS. 1 to 8 was made in the form of a vertical bore emerging in the lower face 11, but it could be done in the continuation of the distribution channel 210, along the longitudinal axis Y, instead and in place of the end that emerges in the peripheral face 12 and which is plugged by the screw 211, as is the case in the embodiment illustrated in FIGS. 9 and 10. In this case, the outer receiver is connected at the peripheral face 12 of the body 1.

Of course, the example embodiment mentioned above is in no way limiting and other details and improvements can be made to the regulator device according to the invention, without, however, going beyond the scope of the invention where other forms of pressure reducer and/or damper can be carried out.

The invention claimed is:

1. A pressure regulator device, in particular of the hydraulic remote-control type, comprising:

a body provided with two end faces, lower and upper, respectively, and a peripheral face extending between the two end faces, and comprising at least one control cavity emerging on at least one of said faces and at least one damping cavity emerging on at least one of said faces, a minimum of a pressure reducer mounted in the body and comprising a control push-piece housed in back and forth motion in the at least one control cavity, said pressure reducer being intended to enable the control of at least one receiver outside the regulator device, a control member pivoting relative to the body, at least one hinge mounted on the upper face of said body, in order to control the back and forth movement of the at least one control push-piece, and at least one damper mounted in the body and comprising two damping push-pieces arranged on either side of said hinge and housed in reciprocating motion in said at least one damping cavity, said damper being intended to damp the tilting of the control member in both directions, said control member pushing on one hand one of said damping push-pieces when it tilts in one direction, and on the other hand the other of said damping push-pieces when it tilts in the other direction, wherein the at least one control cavity has one end emerging in the peripheral face of said body, wherein the at least one damping cavity has two ends emerging in the peripheral face of said body on either side of said hinge of the control member, and wherein the control member has portions opposite the peripheral face to face the emerging ends of the control and damping cavities, respectively, from which the control and damping push-pieces emerge, respectively.

2. The device according to claim 1, comprising a single rectilinear damping cavity passing all the way through the body and emerging at both of its ends on its peripheral face.

3. The device according to claim 2, wherein the at least one control cavity is rectilinear and extends substantially parallel or inclined relative to the damping cavity.

4. The device according to claim 2, wherein the damping cavity and the at least one control cavity extend in substantially parallel planes.

5. The device according to claim 1, wherein the damper comprises a damping slide slidingly and adjustably mounted in the damping cavity, and in which the damping cavity comprises two work chambers, with a variable volume in the opposite direction, extending between the two opposite ends of said damping slide and guide sleeves immobilized at the emerging ends of the damping cavity to guide the respective damping push-pieces in translation, said work chambers containing a fluid intended to pass from one to the other by means of at least one communication passage under the effect of the thrust from one or the other of the damping push-pieces on said damping slide.

6. The device according to claim 5, wherein the communication passage comprises at least one restriction zone adapted to create a load loss in said communication passage when it is passed through by fluid flowing between the two work chambers.

7. The device according to claim 5, wherein the damping slide comprises, at its two respective ends, two respective end pistons sliding in the damping cavity, connected to each other by a central rod, and against which the respective damping push-pieces abut, and wherein the communication passage between the two work chambers is formed in the damping slide between said two end pistons.

8. The device according to claim 7, wherein the communication passage comprises two end channels formed in said end pistons and a central channel formed axially in the central connecting rod between the two end pistons, said end channels putting the respective work chambers and the central channel in fluid communication.

9. The device according to claim 8, wherein the central channel passes all the way through the two end pistons, wherein the damping push-pieces are dimensioned to cover the respective emerging ends of the central channel, and wherein the end channels assume the form of grooves formed on the end faces of the respective end pistons and putting the respective work chambers and the respective emerging ends of the central channel in fluid communication.

10. The device according to claim 9, wherein the grooves have a general spiral shape adapted to form a throttle in the flow of the fluid between the respective work chambers and the central channel.

11. The device according to claim 8, wherein the central channel is inwardly provided with two antagonistic jets designed to create load losses in the flow of the fluid inside said central channel.

12. The device according to claim 7, wherein the distribution slide comprises two intermediate pistons sliding in the damping cavity and arranged around the central rod between the end pistons, so that the distribution slide inwardly defines three inner chambers with a constant volume, comprising two lateral inner chambers arranged between the end pistons and the adjacent intermediate pistons, and a central inner chamber arranged between the two intermediate pistons.

* * * * *